US012601120B2

(12) United States Patent
Anderson et al.

(10) Patent No.: US 12,601,120 B2
(45) Date of Patent: Apr. 14, 2026

(54) OBTAINING PAVING MATERIAL MAT CHARACTERISTICS

(71) Applicant: Caterpillar Paving Products Inc., Brooklyn Park, MN (US)

(72) Inventors: Jonathan A. Anderson, Maple Grove, MN (US); John Marsolek, Watertown, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 989 days.

(21) Appl. No.: 17/658,549

(22) Filed: Apr. 8, 2022

(65) Prior Publication Data

US 2023/0323611 A1 Oct. 12, 2023

(51) Int. Cl.

| | |
|---|---|
| ***E01C 19/00*** | (2006.01) |
| *E01C 19/22* | (2006.01) |
| *E01C 19/48* | (2006.01) |

(52) U.S. Cl.

CPC ..... *E01C 19/004* (2013.01); *E01C 19/22* (2013.01); *E01C 19/48* (2013.01); *E01C 2301/16* (2013.01)

(58) Field of Classification Search

CPC ..... E01C 19/004; E01C 19/22; E01C 19/48; E01C 2301/16

USPC ..... 404/84.05–84.5, 118

See application file for complete search history.

(56) References Cited

U.S. PATENT DOCUMENTS

| | | | | |
|---|---|---|---|---|
| 5,362,176 | A * | 11/1994 | Sovik | E01C 19/006 404/72 |
| 5,556,226 | A * | 9/1996 | Hohmann, Jr. | E01C 19/006 404/101 |
| 5,567,075 | A * | 10/1996 | Allen | E01C 19/006 404/102 |
| 6,171,018 | B1 * | 1/2001 | Ohtomo | E01C 19/006 404/84.1 |
| 6,749,364 | B1 | 6/2004 | Baker et al. | |
| 7,204,657 | B2 * | 4/2007 | Jackson | E04F 21/242 404/85 |
| 7,399,139 | B2 * | 7/2008 | Kieranen | E01C 19/006 404/83 |
| 8,794,868 | B2 | 8/2014 | Fritz | |
| 10,480,131 | B1 | 11/2019 | McAlpine et al. | |
| 10,676,879 | B2 | 6/2020 | Laugwitz | |
| 2006/0198700 | A1 * | 9/2006 | Maier | G01C 15/002 404/84.1 |

(Continued)

FOREIGN PATENT DOCUMENTS

DE 19951296 C2 6/2001

*Primary Examiner* — Raymond W Addie

(57) ABSTRACT

In some implementations, a control system may include at least one total station prism connected to a screed assembly of a paving machine, and a controller. The controller may be configured to obtain paving information that indicates locations of edges of a mat of paving material deposited by the paving machine. The paving information may indicate the locations of the edges based on data collected using the at least one total station prism. The controller may be configured to determine, based on the locations of the edges, an operating plan for one or more compactor machines that are to provide compaction of the mat. The controller may be configured to transmit, to another controller for the one or more compactor machines, plan information that indicates the operating plan.

15 Claims, 4 Drawing Sheets

(56) References Cited

U.S. PATENT DOCUMENTS

| | | | | |
|---|---|---|---|---|
| 2010/0183369 | A1* | 7/2010 | Lindley | G01C 15/006 404/84.5 |
| 2010/0239368 | A1* | 9/2010 | Lickel | E04F 21/242 404/114 |
| 2011/0085859 | A1* | 4/2011 | Yost | E01C 19/486 404/84.5 |
| 2014/0186115 | A1* | 7/2014 | Graham | E01C 19/4873 404/75 |
| 2014/0308073 | A1* | 10/2014 | Delius | G01J 5/02 404/72 |
| 2018/0030672 | A1* | 2/2018 | Marsolek | E01C 23/07 |
| 2019/0106846 | A1* | 4/2019 | Marsolek | E01C 19/23 |
| 2020/0117201 | A1* | 4/2020 | Oetken | G05D 1/0231 |
| 2020/0292348 | A1* | 9/2020 | Chambers | G06F 30/10 |
| 2020/0332479 | A1 | 10/2020 | O'Donnell | |
| 2021/0010210 | A1* | 1/2021 | Ellwein | E01C 19/48 |
| 2021/0324587 | A1 | 10/2021 | Marsolek et al. | |

* cited by examiner

OBTAINING PAVING MATERIAL MAT CHARACTERISTICS

TECHNICAL FIELD

The present disclosure relates generally to paving machines and, for example, to obtaining paving material mat characteristics.

BACKGROUND

Paving machines are used to lay and level a paving material such as asphalt, on a ground surface for the construction of roads, bridges, parking lots, and other such surfaces. In general, paving machines include a chassis, a hopper for storing the paving material, an auger that distributes the paving material on a ground surface, and a screed assembly that compacts/levels the paving material to a desired mat thickness. Following deposition of a mat of paving material by the paving machine, a compactor machine may travel over the mat to further compact the paving material.

Often, the compactor machine is manually operated, which may limit the productivity of the compactor machine and/or result in imprecise compaction of the mat. Moreover, manual operation of the compactor machine may be performed without an operating plan or without regard to an operating plan, thereby resulting in the compactor machine being operated in a manner that is inefficient. For example, the paths in which the compactor machine travels over the mat, the quantity of passes over the mat made by the compactor machine, the time duration for which the compactor machine operates on the mat, or the like, may lack efficiency.

Germany Patent No. 19951296 (the '296 patent) discloses that a prism may be attached to a rear edge of a screed, on the outside of a movable part of the screed, via a mast. The '296 patent indicates that a total station can determine an angle and a distance of the prism with respect to the total station and can transmit this information to a receiver. The '296 patent discloses that a three-dimensional (3D) computer may receive the spatial coordinates of the spatial position of the prism from the total station, and the 3D computer may calculate a 3D position deviation of the screed's trailing edge. The '296 patent discloses that a processing device may control the movable parts of the screed and the working height of the screed in such a way for which any instantaneous positional deviation of the screed from a desired road course is compensated.

While the '296 patent discloses the use of a prism and a total station to obtain spatial information relating to a screed, the '296 patent does not indicate that the spatial information may be used to identify the boundaries of a mat of paving material deposited by the screed. Moreover, the '296 patent does not indicate that an operating plan for a compactor machine may be determined based on the boundaries of the mat. Accordingly, the techniques of the '296 patent do not relate to improving the efficiency, precision, and/or productivity of compaction operations performed by compactor machines.

The control system of the present disclosure solves one or more of the problems set forth above and/or other problems in the art.

SUMMARY

In some implementations, a method includes obtaining, by a controller, paving information that indicates locations of edges of a mat of paving material deposited by a paving machine. The paving information may indicate the locations of the edges based on data collected using one or more total station prisms connected to a screed assembly of the paving machine. The method may include determining, by the controller and based on the locations of the edges, an operating plan for one or more compactor machines that are to provide compaction of the mat. The method may include transmitting, by the controller to another controller for the one or more compactor machines, plan information that indicates the operating plan.

In some implementations, a paving machine includes a screed assembly, at least one detection component connected to the screed assembly, and a controller. The controller may be configured to obtain paving information that indicates locations of edges of a mat of paving material deposited by the paving machine. The paving information may indicate the locations of the edges based on data collected using the at least one detection component. The controller may be configured to determine, based on the locations of the edges, an operating plan for autonomous operation of one or more compactor machines that are to provide compaction of the mat. The controller may be configured to transmit, to another controller for the one or more compactor machines, plan information that indicates the operating plan.

In some implementations, a control system includes at least one total station prism connected to a screed assembly of a paving machine, and a controller. The controller may be configured to obtain paving information that indicates locations of edges of a mat of paving material deposited by the paving machine. The paving information may indicate the locations of the edges based on data collected using the at least one total station prism. The controller may be configured to determine, based on the locations of the edges, an operating plan for one or more compactor machines that are to provide compaction of the mat. The controller may be configured to transmit, to another controller for the one or more compactor machines, plan information that indicates the operating plan.

DETAILED DESCRIPTION

Figure 1:
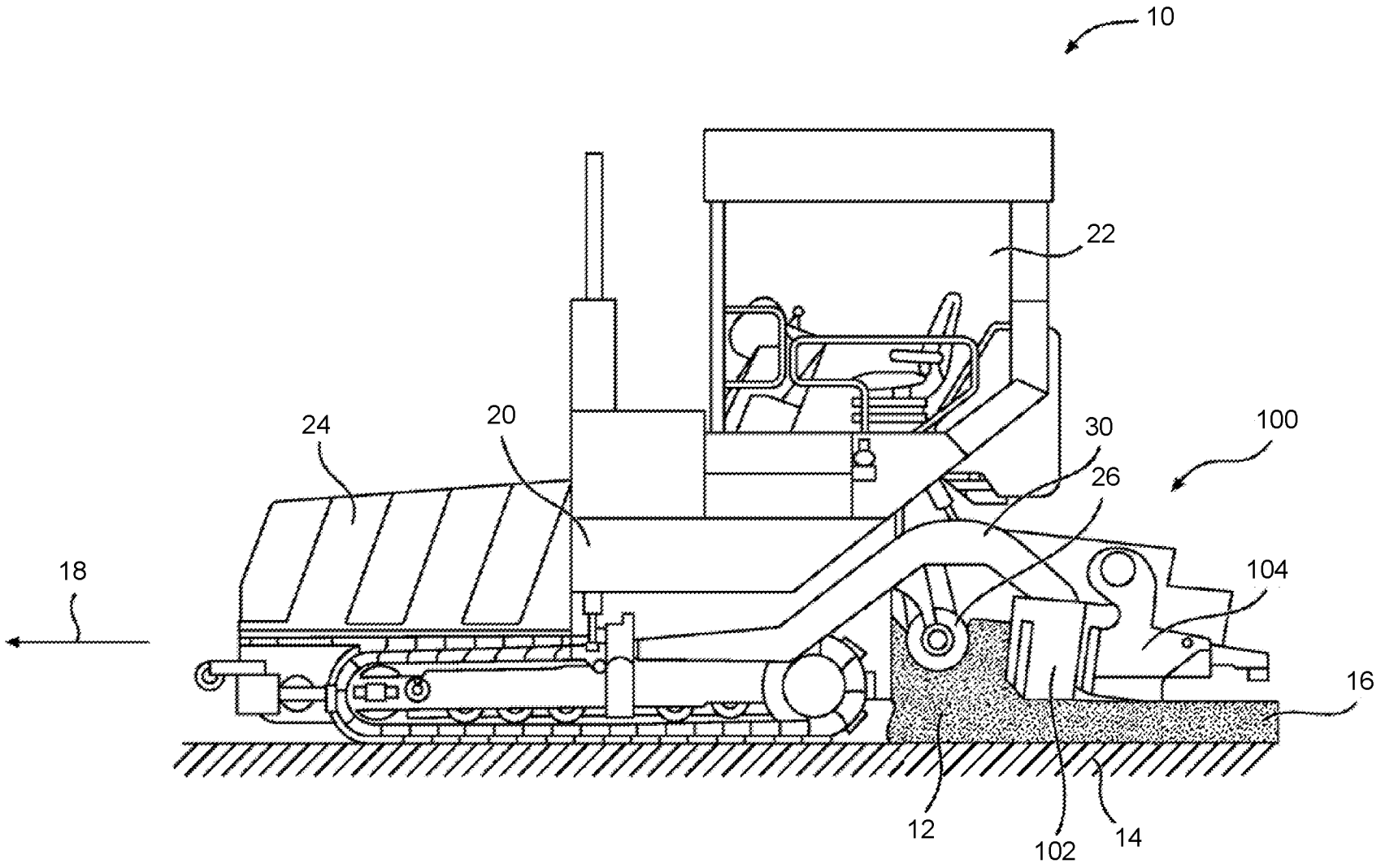
FIG. 1 is a diagram of an example paving machine that includes a screed assembly.

FIG. 1 is a diagram of an example paving machine 10 that includes a screed assembly 100. The paving machine 10 is used to level and compact a paving material 12, such as hot mix asphalt, on a ground surface 14 to provide a mat 16 of paved material. As used herein, a "forward" position refers to positions that are that are located toward the front of the paving machine 10 with respect to a direction of travel 18 of the paving machine, while an "aft" position refers to positions that are located toward the rear of the paving machine 10 with respect to the direction of travel 18.

The paving machine 10 includes a chassis 20, which may have a track-style traveling mechanism (shown) or may be on wheels, as well as a passenger cab 22 mounted on the chassis 20. In addition, the paving machine 10 includes a hopper 24 mounted near the forward end of the paving machine 10 that stores the paving material 12, and a distributing device 26, such as an auger, that distributes the paving material 12 on the ground surface 14.

The screed assembly 100 is configured to level and compact the paving material 12 on the ground surface 14. The screed assembly 100 is mounted on the aft side of the paving machine 10 behind the distributing device 26 via one or more arms 30, as shown. As described further below, the screed assembly 100 may include a main screed 102 and one or more extension screeds 104 movably coupled to the main screed 102.

As indicated above, FIG. 1 is provided as an example. Other examples may differ from what is described in connection with FIG. 1.

Figure 2:
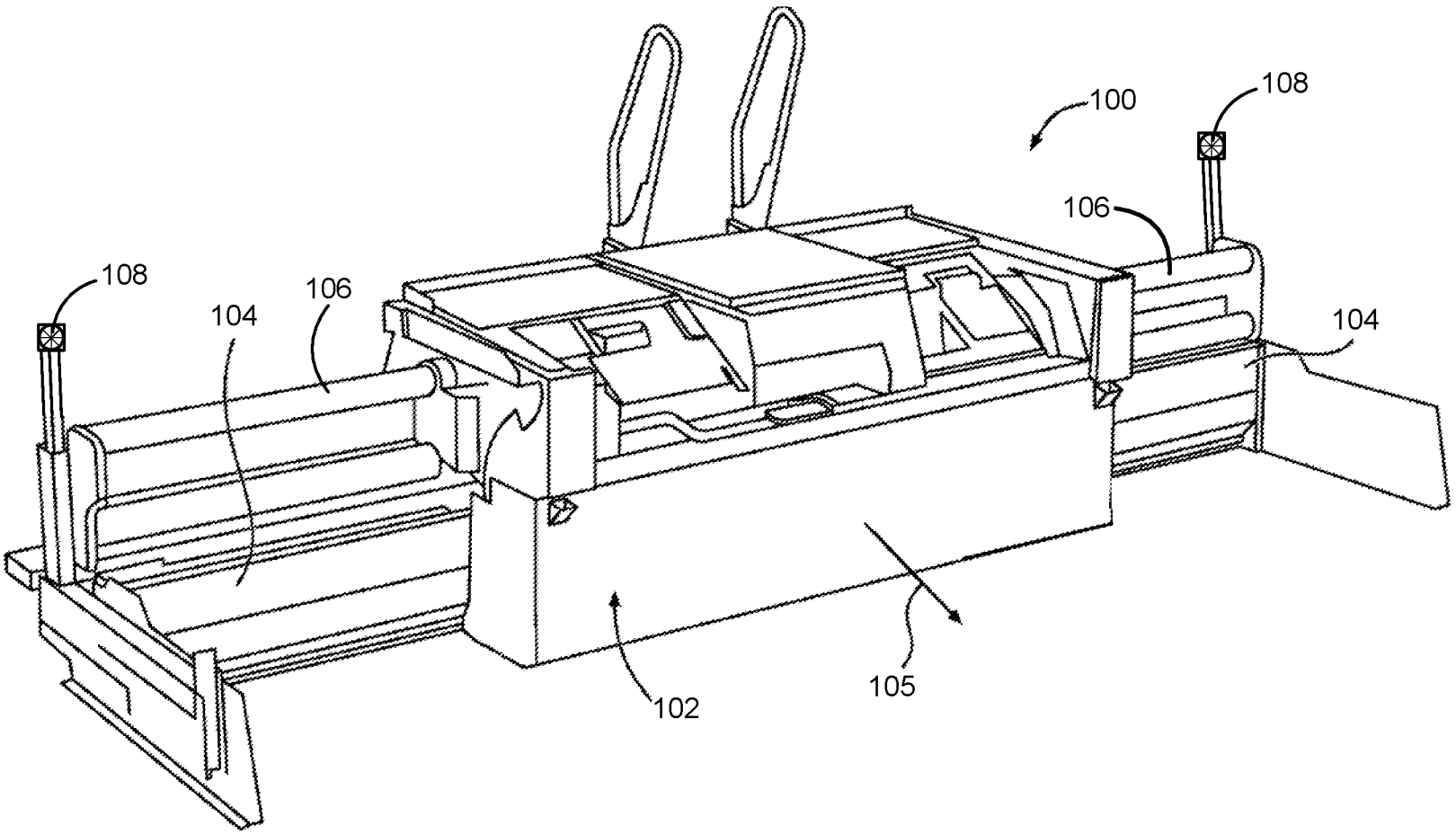
FIG. 2 is a diagram of an example screed assembly.

FIG. 2 is a diagram of an example of the screed assembly 100. As shown, the main screed 102 is centrally located in the screed assembly 100. The extension screeds 104 are movably coupled (e.g., slidably coupled) to the main screed 102 with one extension screed 104 on each lateral end of the main screed 102. Other possible arrangements may include a single extension screed, more than two extension screeds, or none at all. The extension screeds 104 are laterally extendable and retractable with respect to the main screed 102 and perpendicularly to a central axis 105 of the screed assembly 100, thereby allowing an operator to control and/or select a width of the screed assembly 100. For example, extension and retraction of the extension screeds 104 may provide adjustment for variations in the width of the ground surface 14. Each extension screed 104 may be translated laterally inward toward the main screed 102 or laterally outward away from the main screed 102 by an actuator 106 (e.g., a hydraulic cylinder, or the like). That is, an actuator 106 may be configured to extend and retract an extension screed 104 with respect to the main screed 102.

As further shown in FIG. 2, detection components 108 (shown as total station prisms) are connected to the screed assembly 100. For example, each detection component 108 may be connected to a respective extension screed 104 or actuator 106 of the screed assembly 100. In some implementations, a detection component 108 may be connected to a distal end of an antenna (e.g., a pole, a post, or the like) that extends from the screed assembly 100 (e.g., from an extension screed 104 or an actuator 106 of the screed assembly 100).

As indicated above, FIG. 2 is provided as an example. Other examples may differ from what is described in connection with FIG. 2.

Figure 3:
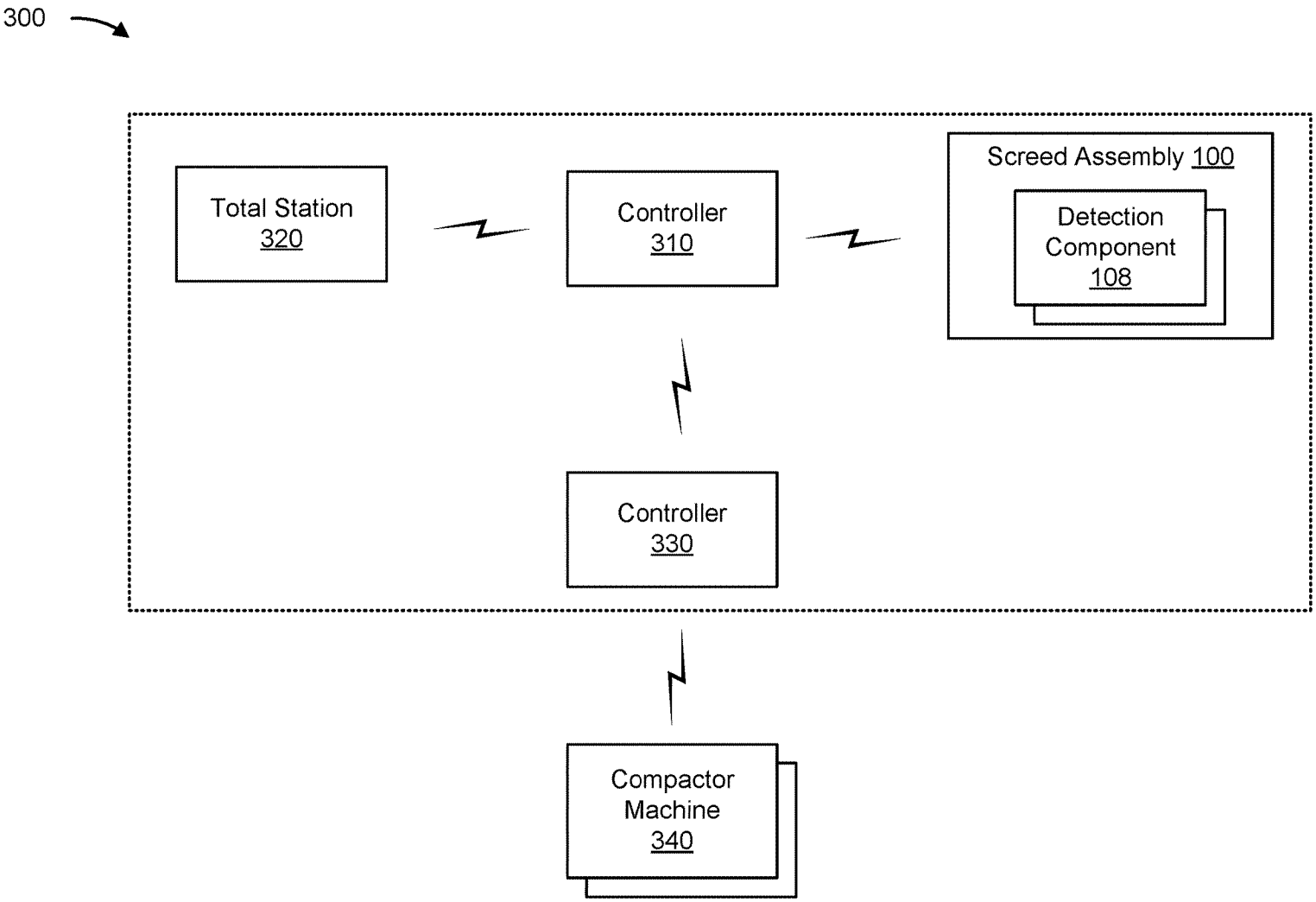
FIG. 3 is a diagram of an example control system.

FIG. 3 is a diagram of an example control system 300. The control system 300 includes at least one detection component 108 and a controller 310. The detection component 108 may include a total station prism (e.g., an optical survey prism), a light detection and ranging (LIDAR) system, a radio detection and ranging (RADAR) system, a camera, and/or a global navigation satellite system (GNSS) receiver, among other examples. For example, as described herein, a LIDAR system, a RADAR system, a camera, or the like, may be connected to one or more antennas that project (e.g., vertically, relative to the ground surface 14) from the screed assembly 100. As another example, as described herein, a total station prism and/or a GNSS receiver may be connected to one or more of the extension screeds 104 and/or one or more of the actuators 106 of the screed assembly 100 (e.g., via one or more antennas that project from the extension screed(s) 104 and/or the actuator(s) 106). In this way, when an extension screed 104/actuator 106 is laterally translated to accommodate different paving widths during a paving operation of the paving machine 10, the total station prism and/or the GNSS receiver is likewise translated laterally.

A total station 320 may operate using one or more total station prisms connected to the screed assembly (e.g., the total station 320 may collect data indicating locations of the total station(s) during a paving operation of the paving machine 10). Thus, the total station 320 may detect lateral translations of the total station(s) during the paving operation of the paving machine 10. The total station 320 may be positioned remotely from the paving machine 10. In some implementations, the control system 300 may include the total station 320.

The GNSS receiver(s) may collect data indicating locations of the GNSS receiver(s). A location accuracy of a GNSS receiver may be improved using real-time kinematic positioning (RTK). Here, the GNSS receiver (e.g., an RTK rover) may communicate with an RTK base station (not shown), that has a fixed location, to obtain correction data used to improve the location accuracy of the GNSS receiver. In some implementations, the control system 300 may include the RTK base station.

The controller 310 may include one or more memories and/or one or more processors coupled to the one or more memories. Additionally, the controller 310 may include a communication interface for communicating with other devices described herein (e.g., via a network). The controller 310 may be configured to perform (e.g., the one or more memories may store instructions that, when executed by the one or more processors, cause the one or more processors to perform) operations associated with obtaining paving information, determining an operating plan, and transmitting plan information, as described herein.

In connection with a paving operation of the paving machine 10, the controller 310 may obtain paving information. For example, the controller 310 may obtain the paving information continuously, in real-time during the paving operation. As another example, the controller 310 may obtain the paving information following completion of the paving operation (e.g., the paving information may be collected in real-time during the paving operation and stored elsewhere, and the paving information may be provided to the controller 310 at a completion of the paving operation).

The paving information may indicate locations of edges of a mat (e.g., mat 16) of paving material deposited by the paving machine 10. The edges of the mat may correspond to a boundary of the mat, where paving material deposited by the paving machine 10 is within the boundary and un-paved ground surface is outside of the boundary. The locations of the edges of the mat may be indicated in the paving information by spatial coordinates (e.g., latitude and longitude coordinates) or the like. Thus, the paving information may include a plurality of spatial coordinates indicative of the locations of the edges of the mat.

The paving information indicating the locations of the edges may be based on data collected using at least one detection component 108. In some examples, the paving information indicating the locations of the edges may be based on data collected using one or more total station prisms that are connected to the screed assembly 100, as described herein. Here, the controller 310 may obtain (e.g., receive) the paving information indicating the locations of the edges from the total station 320, which may operate using the one or more total station prisms. In some examples, the paving information indicating the locations of the edges may be based on data collected using one or more LIDAR systems, one or more RADAR systems, one or more cameras, and/or one or more GNSS receivers. Here, the controller 310 may obtain (e.g., receive) the paving information indicating the locations of the edges from the one or more LIDAR systems, the one or more RADAR systems, the one or more cameras, and/or the one or more GNSS receivers.

The paving information, to indicate the locations of the edges, may include location information relating to the total station prism(s) and/or the GNSS receiver(s). Here, the controller 310 may determine the locations of the edges based on the location information. For example, the controller 310 may be configured with calibration information that indicates a distance offset between the position of a total station prism and/or a GNSS receiver on the screed assembly 100 and an edge of the screed assembly 100 that defines the edge of the mat during paving. Accordingly, the controller 310 may apply the distance offset to the location information to determine the locations of the edges. In some other cases, the paving information may include location information that directly indicates the locations of the edges.

Additionally, or alternatively, the paving information may indicate a thickness profile of the mat, a thermal profile of the mat, and/or a speed profile of the screed assembly 100. The thickness profile may include thickness mapping data that indicates thicknesses (e.g., depths) throughout the mat. The controller 310 may obtain the paving information indicating the thickness profile from a sensor, such as a camera, an ultrasonic transducer, or the like, that is connected to the screed assembly 100 or the paving machine 10. The thermal profile of the mat may include thermal mapping data that indicates temperatures throughout the mat. The controller 310 may obtain the paving information indicating the thermal profile from a sensor, such as a thermal imager, a temperature sensor, or the like, that is connected to the screed assembly 100 or the paving machine 10. The speed profile may include speed mapping data that indicates speeds at which the screed assembly 100 (or paving machine 10) was traveling across the mat. The controller 310 may obtain the paving information indicating the speed profile from a sensor, such as a speed sensor, a tachometer, or the like, that is connected to the screed assembly 100 or the paving machine 10.

The controller 310 may determine, based on the paving information, an operating plan for one or more compactor machines 340 that are to provide compaction of the mat. For example, the paving information may be an input to one or more algorithms and/or machine learning models that are used by the controller to determine the operating plan.

The controller 310 may determine the operating plan based on the locations of the edges of the mat indicated by the paving information. For example, the controller 310 may determine, based on the locations of the edges, a pattern in which the one or more compactor machines 340 are to move with respect the mat. The pattern may indicate one or more paths in which a compactor machine 340 is to move and/or a quantity of passes of a path or portion thereof that the compactor machine 340 is to make, among other examples. The controller 310 may determine the pattern so that the integrity of the mat and the boundaries of the mat are maintained during compaction. For example, the controller 310 may determine the pattern so that the compactor machine 340 is to maintain a particular distance from the edges of the mat at some portions of the one or more paths, is to travel across an edge of the mat at some portions of the one or more paths, and/or is to travel along an edge of the mat at some portions of the one or more paths.

Additionally, or alternatively, the controller 310 may determine the operating plan based on the thickness profile, the thermal profile, and/or the speed profile indicated by the paving information. For example, the controller 310 may determine, based on the thickness profile, the thermal profile, and/or the speed profile, a time duration for which the one or more compactor machines 340 are to operate (e.g., perform compaction) on the mat. The time duration may relate to a total time duration for which a compactor machine 340 is to operate on the mat, or a time duration for which the compactor machine 340 is to operate on a particular area (e.g., a particular path or portion thereof) of the mat. Thus, the time duration may indicate a speed at which the compactor machine 340 is to operate (e.g., a constant speed at which the compactor machine 340 is to operate and/or different speeds at which the compactor machine 340 is to operate for different areas of the mat). The thickness profile, the thermal profile, and the speed profile may all provide an indication (directly or indirectly) of temperatures throughout the mat. For example, thicker areas of the mat may be hotter than thinner areas of the mat. As another example, a degree to which an area of the mat has cooled since that area of the mat was deposited may be a function of a speed at which that area of the mat was deposited. Thus, the controller 310 may determine the time duration so that compaction of an area of the mat is performed when that area of the mat is at a suitable temperature for compaction (e.g., a minimum temperature for proper compaction, a maximum temperature for proper compaction, an optimal temperature for proper compaction, or the like).

In some implementations, the controller 310 may determine the pattern in which the one or more compactor machines 340 are to move further based on the thickness profile, the thermal profile, and/or the speed profile. For example, thicker areas of the mat, hotter areas of the mat, and/or areas of mat that were deposited more quickly may require less compaction passes. Additionally, or alternatively, the controller 310 may determine the time duration for which the one or more compactor machines 340 are to operate on the mat further based on the locations of the edges of the mat. For example, if the locations of the edges indicate a larger mat, more time on the mat may be required.

The controller 310 may transmit plan information that indicates the operating plan to another controller 330. The controller 330 may be for the one or more compactor machines 340. For example, a compactor machine 340 may include the controller 330. As another example, the controller 330 may be located remotely from the one or more compactor machines 340, and the controller 330 may provide operating instructions to the one or more compactor machines 340. As described herein, the plan information that indicates the operating plan may indicate the pattern in which the one or more compactor machines 340 are to move with respect to the mat and/or the time duration for which the one or more compactor machines 340 are to operate on the mat.

The operating plan may be for autonomous operation of the one or more compactor machines 340. Thus, the controller 310 may transmit the plan information that indicates the operating plan to cause autonomous operation of the one or more compactor machines 340 in accordance with the operating plan. For example, the controller 330 may provide autonomous operating instructions to the one or more compactor machine 340 based on the plan information. Alternatively, the operating plan may be for guiding manual operation of the one or more compactor machines 340. Thus, the controller 310 may transmit the plan information that indicates the operating plan to cause a compactor machine 340 to present, on a display, information relating to the operating plan (e.g., graphic or textual information indicating the pattern and/or the time duration) and/or to provide feedback (e.g., in a user interface, using an indicator light, using a siren, using haptic feedback, or the like) to an operator of the compactor machine 340 during manual execution of the operating plan.

In some implementations, the control system 300 may include the controller 330. The controller 310 described herein may be included in the paving machine 10, in the screed assembly 100, or in a compactor machine 340. Alternatively, the controller 310 described herein may be remotely located from the paving machine 10, the screed assembly 100, and the compactor machine(s) 340.

As indicated above, FIG. 3 is provided as an example. Other examples may differ from what is described in connection with FIG. 3.

Figure 4:
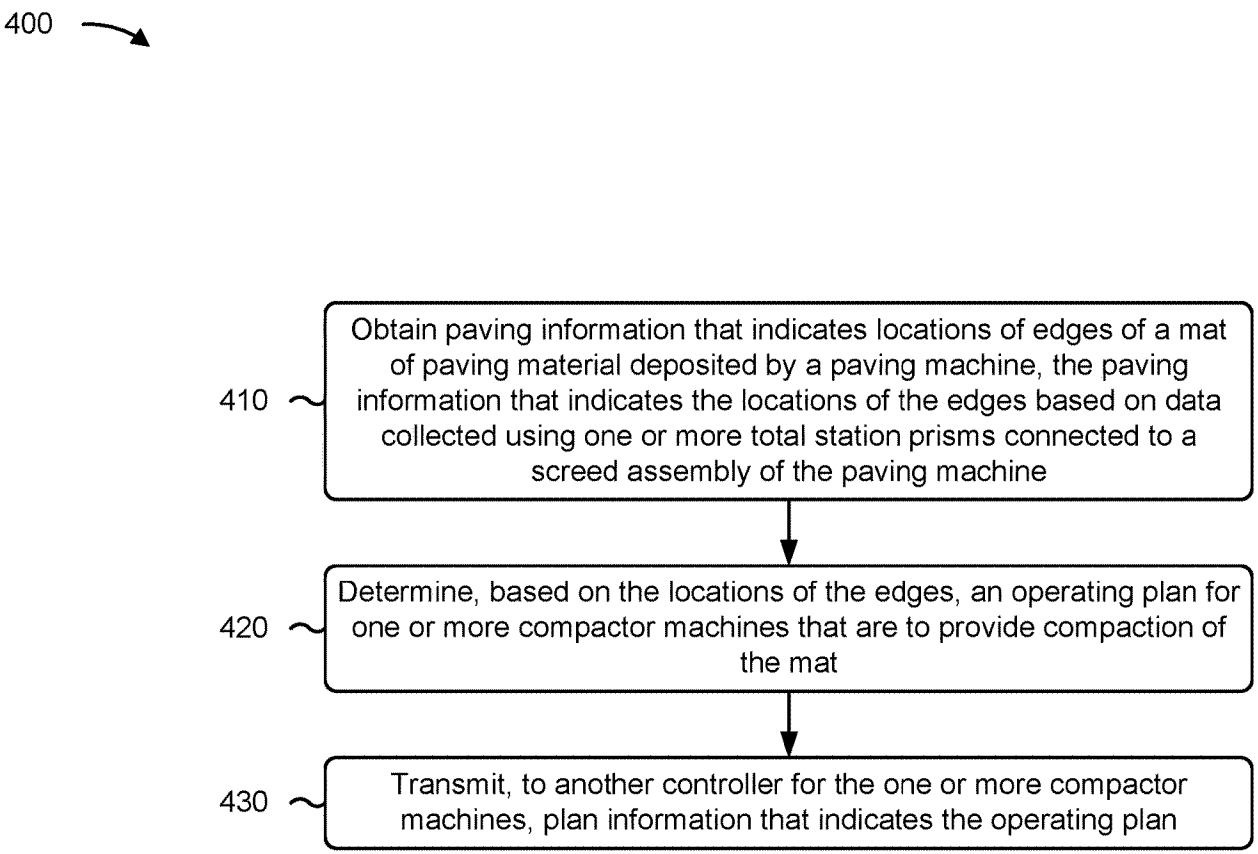
FIG. 4 is a flowchart of an example process relating to obtaining paving material mat characteristics.

FIG. 4 is a flowchart of an example process 400 associated with obtaining paving material mat characteristics. One or more process blocks of FIG. 4 may be performed by a controller (e.g., controller 310). Additionally, or alternatively, one or more process blocks of FIG. 4 may be performed by another device or a group of devices separate from or including the controller, such as another device or component that is internal or external to the paving machine 10.

As shown in FIG. 4, process 400 may include obtaining paving information that indicates locations of edges of a mat of paving material deposited by a paving machine, the paving information that indicates the locations of the edges based on data collected using one or more total station prisms connected to a screed assembly of the paving machine (block 410). For example, the controller (e.g., using a processor, a memory, a communication interface, or the like) may obtain the paving information, as described above. The paving information may further indicate one or more of a thickness profile of the mat, a thermal profile of the mat, or a speed profile of the screed assembly. The paving information that indicates the locations of the edges may be obtained from a total station operating using the one or more total station prisms.

As further shown in FIG. 4, process 400 may include determining, based on the locations of the edges, an operating plan for one or more compactor machines that are to provide compaction of the mat (block 420). For example, the controller (e.g., using a processor, a memory, or the like) may determine the operating plan, as described above. The operating plan may be determined further based on one or more of the thickness profile, the thermal profile, or the speed profile. Determining the operating plan may include determining, based on the locations of the edges of the mat, a pattern in which the one or more compactor machines are to move with respect to the mat, and determining, based on one or more of the thickness profile, the thermal profile, or the speed profile, a time duration for which the one or more compactor machines are to operate on the mat. The operating plan may be for autonomous operation of the one or more compactor machines. Alternatively, the operating plan may be for guiding manual operation of the one or more compactor machines.

As further shown in FIG. 4, process 400 may include transmitting, to another controller for the one or more compactor machines, plan information that indicates the operating plan (block 430). For example, the controller (e.g., using a processor, a memory, a communication interface, or the like) may transmit the plan information. The plan information that indicates the operating plan may indicate at least one of a pattern in which the one or more compactor machines are to move with respect to the mat, or a time duration for which the one or more compactor machines are to operate on the mat.

Although FIG. 4 shows example blocks of process 400, in some implementations, process 400 may include additional blocks, fewer blocks, different blocks, or differently arranged blocks than those depicted in FIG. 4. Additionally, or alternatively, two or more of the blocks of process 400 may be performed in parallel.

INDUSTRIAL APPLICABILITY

The control system described herein may be used with any machine that deposits paving material on a ground surface. In particular, the control system described herein may be used with any paving machine that is to deposit paving material on a ground surface for subsequent compaction by a compactor machine. The control system facilitates high-precision detection of the locations of edges of a mat of paving material that is deposited. For example, while the paving machine is performing a paving operation, the locations of the edges of the mat deposited by the paving machine may be detected with high precision using at least one detection component of the control system. The at least one detection component may include total station prisms that are connected to each of the lateral ends of a screed assembly of the paving machine. Thus, as a width of the screed assembly is adjusted during the paving operation (e.g., to achieve different paving widths), the total station prisms facilitate the collection of data relating to the positions of the screed assembly during the paving operation. The positions of the screed assembly may be indicative of the locations of the edges of the mat.

Moreover, the control system is useful for determining an operating plan for one or more compactor machines based on the locations of the edges of the mat. The operating plan may be optimized for efficiency, precision, and/or productivity using the high-precision data relating to the positions of the screed assembly/locations of the edges of the mat. The operating plan may be used for autonomous operation of the compactor machines. Autonomous operation of the compactor machines provides compaction of the mat with improved efficiency, productivity, and precision.

In addition, the operating plan may be determined based on actual characteristics of the mat that is deposited by the paving machine. This may eliminate the need to generate, prior to paving, an operating plan for a compactor machine that may not accurately reflect actual paving characteristics and/or that may need to be updated upon completion of the paving. Accordingly, computing resources associated with generating an operating plan prior to paving and/or updating the operating plan upon completion of the paving may be conserved.

What is claimed is:

1. A method, comprising:

receiving, by a controller, location information relating to locations of one or more total station prisms connected to a screed assembly of a paving machine while the paving machine is performing a paving operation;

receiving, by the controller, paving information relating to a thermal profile of a mat of paving material deposited by the paving machine during the paving operation;

determining, by the controller, locations of edges of the mat of paving material deposited by the paving machine based on the location information and a distance offset between a position of the one or more total station prisms on the screed assembly and an edge of the screed assembly;

determining, by the controller and based on the locations of the edges of the mat, a pattern in which one or more compactor machines are to move with respect to the mat;

determining, by the controller and based on the thermal profile, a time duration for which the one or more compactor machines are to operate on the mat;

determining, by the controller and based on the locations of the edges, an operating plan for the one or more compactor machines that are to provide compaction of the mat, the operating plan indicating the pattern and the time duration; and transmitting, by the controller to another controller for the one or more compactor machines, plan information that indicates the operating plan.

2. The method of claim 1, wherein the paving information further relates to one or more of:

a thickness profile of the mat, or a speed profile of the screed assembly.

3. The method of claim 2, wherein the operating plan is determined further based on one or more of the thickness profile or the speed profile.

4. The method of claim 1, wherein the operating plan is for guiding manual operation of the one or more compactor machines.

5. The method of claim 1, wherein the location information is received from a total station operating using the one or more total station prisms.

6. The method of claim 1, wherein the operating plan is for autonomous operation of the one or more compactor machines.

7. A paving machine, comprising:

a screed assembly;

at least one detection component connected to the screed assembly, wherein the at least one detection component is a total station prism; and a controller configured to:

receive location information relating to a location of the at least one detection component while the paving machine is performing a paving operation;

receive paving information relating to a thermal profile of a mat of paving material deposited by the paving machine during the paving operation;

determine locations of edges of the mat of paving material deposited by the paving machine based on the location information;

determine, based on the locations of the edges of the mat, a pattern in which one or more compactor machines are to move with respect to the mat;

determine, based on the thermal profile, a time duration for which the one or more compactor machines are to operate on the mat;

determine, based on the locations of the edges, an operating plan for autonomous operation of the one or more compactor machines that are to provide compaction of the mat, the operating plan indicating the pattern and the time duration; and transmit, to another controller for the one or more compactor machines, plan information that indicates the operating plan.

8. The paving machine of claim 7, wherein the controller, to receive the location information, is configured to:

receive the location information from a total station operating using the total station prism.

9. The paving machine of claim 7, wherein the paving information further relates to one or more of:

a thickness profile of the mat, or a speed profile of the screed assembly.

10. The paving machine of claim 7, wherein the screed assembly comprises:

a main screed;

at least one extension screed movably coupled to the main screed; and at least one actuator configured to extend and retract the at least one extension screed with respect to the main screed.

11. The paving machine of claim 10, wherein the at least one detection component is connected to the at least one extension screed or the at least one actuator.

12. A control system, comprising:

at least one total station prism connected to a screed assembly of a paving machine; and a controller configured to:

receive location information relating to a location of the at least one total station prism while the paving machine is performing a paving operation;

receive paving information relating to a thermal profile of a mat of paving material deposited by the paving machine during the paving operation;

determine locations of edges of the mat of paving material deposited by the paving machine based on the location information;

determine, based on the locations of the edges of the mat, a pattern in which one or more compactor machines are to move with respect to the mat;

determine, based on the thermal profile, a time duration for which the one or more compactor machines are to operate on the mat;

determine, based on the locations of the edges, an operating plan for the one or more compactor machines that are to provide compaction of the mat, the operating plan indicating the pattern and the time duration; and transmit, to another controller for the one or more compactor machines, plan information that indicates the operating plan.

13. The control system of claim 12, wherein the controller, to receive the location information, is configured to:

receive the location information from a total station operating using the at least one total station prism.

14. The control system of claim 12, wherein the paving information further relates to one or more of:

a thickness profile of the mat, or a speed profile of the screed assembly.

15. The control system of claim 12, wherein the operating plan is for autonomous operation of the one or more compactor machines.

* * * * *